US005388759A

United States Patent [19]

Barnes

[11] Patent Number: 5,388,759

[45] Date of Patent: Feb. 14, 1995

[54] DELIVERY SIGN FOR A RURAL MAILBOX

[76] Inventor: Gary M. Barnes, Rte. 4 Box 271, Nashville, N.C. 27856

[21] Appl. No.: 12,448

[22] Filed: Feb. 2, 1993

[51] Int. Cl.[6] ..... B65D 91/00

[52] U.S. Cl. ..... 232/35

[58] Field of Search ..... 232/34, 35, 17, 37

[56] References Cited

U.S. PATENT DOCUMENTS

| | | | |
|---|---|---|---|
| 390,072 | 9/1888 | Eckerson | 232/35 |
| 2,807,410 | 9/1957 | Ward | 232/35 |
| 2,856,123 | 10/1958 | Mary | 232/35 |
| 3,620,444 | 11/1971 | Crozier | 232/35 |
| 3,709,189 | 1/1973 | Widham | 232/35 |
| 4,262,839 | 4/1981 | Wisniewski | 232/35 |
| 4,382,542 | 5/1983 | Farris | 232/35 |
| 4,655,390 | 4/1987 | Martin | 232/35 |
| 4,708,286 | 11/1987 | Norris | 232/35 |

*Primary Examiner*—Michael Milano

[57] ABSTRACT

The signal device, secured to the door of a rural mailbox, shows that mail has been received. The device operates by opening a shutter to display the message, "MAIL," when the mail carrier opens the mailbox door. It operates by gravity and latches magnetically. The shutter opens as a venetian blind when the weighted screen falls forward. The signal device is reset by pushing the reset tab. The device returns to the closed position by gravity. In the closed position the message, "NO MAIL," printed on the shutter, is displayed. Moving parts are contained in a weather-proof box with a transparent window. The messages, "MAIL," or "NO MAIL" are visible through the transparent window.

5 Claims, 1 Drawing Sheet

DELIVERY SIGN FOR A RURAL MAILBOX

BACKGROUND OF THE INVENTION

1. Field of the Invention

The present invention relates to a signalling device for rural mailboxes. More specifically, the present invention relates to a mailbox signal unit that when applied to the Standard Model 1-1 Mailbox will show if the box has been serviced.

2. Prior Art

Often times circumstances such as traffic and weather make checking the mailbox for delivery an unpleasant and sometimes hazardous undertaking. In the past, the mailbox would have to be physically checked everyday to determine if any mail has been put in the box.

Other signal devices of some nature have been patented, but none has any reference or likeness to the unit stated in this paper other than having the same purpose. Patent numbers of known signal devices back to 1969 are as follows U.S. Pat. Nos.:

1. 2,613,031
2. 2,864,553
3. 3,559,876
4. 4,066,209
5. 4,344,559
6. 4,382,541
7. 4,706,880
8. 4,771,941
9. 4,596,357
10. 4,685,612
11. 4,524,905
12. 4,171,086
13. 4,728,028
14. 4,877,180

All of the above patent numbers were checked on Jan. 8, 1993 for similiarities to this device—back to the year 1969. According to a computer run off sheet and the patent books at the D. H. Hill Library at North Carolina State University in Raleigh, N.C., there are no similiarities.

SUMMARY OF THE INVENTION

The principal object of the present invention is to provide a device for use on a rural mailbox which will indicate if the box has been serviced.

It also is an object of the present invention to provide such a device which is of simple, inexpensive construction.

Another object is to provide such a device that can be easily installed.

A further object is to provide such a device which, in use, will make it unnecessary for a mailbox to be checked unless it has been serviced. This will keep the owner from crossing busy streets, going out in the rain or cold, and wasting time in checking an empty mailbox.

The foregoing objects can be accomplished by providing a device that when attached to a rural mailbox and the mailbox door is opened, the unit is tilted forward, which causes the back screen indicator to drop. The attached magnet then swings down and sticks to the metal locking tab which causes gears to move and open the shutter. The mail screen indicator will now read "MAIL" to indicate the mailbox has been serviced. Once the box has been checked, a reset button can be pushed to release the magnet from the metal locking tab which causes the gears to move again which closes the shutter and it reads "NO MAIL" again.

DETAILED DESCRIPTION

Following are the figure numbers and their descriptions:

#1—Unit Housing—exterior portion of signal device used to house and protect interior working parts. Made of a light material as not to interfere with the weight, operation, or latch of the rural mailbox door.

#2—Shows the transparent viewing plastic window.

#3—Shutter assembly—changes the signal device sign from reading "NO MAIL" to "MAIL" and back again.

#4—Back screen with "MAIL" printed on it.

#5—Back screen weight.

#6—Magnet—used to hold the screen in place.

#7—Glue on strips—Used for easy installation of device to a rural mailbox.

#8—Slot only.

#9—Metal Tab—used to hold magnet in place when box is opened.

#10—Bottom Swing Bar for screen assembly.

#11—Gear attached to back screen to move shutter.

#12—Gear to operate shutter when moved.

#13—Reset lever to put unit back to original "NO MAIL" position.

Figure 1:
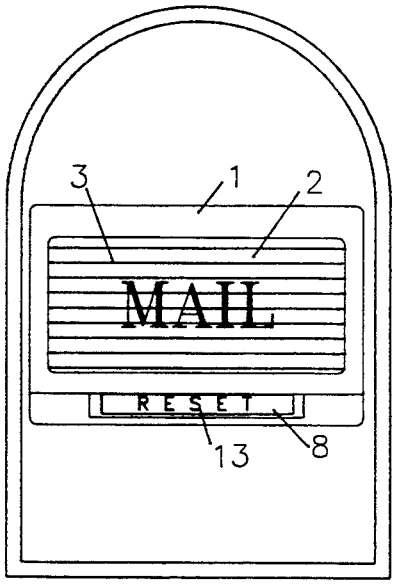
FIG. 1 is a front view of a mailbox after the mail carrier has left and the box is closed back to a normal position.
Figure 2:
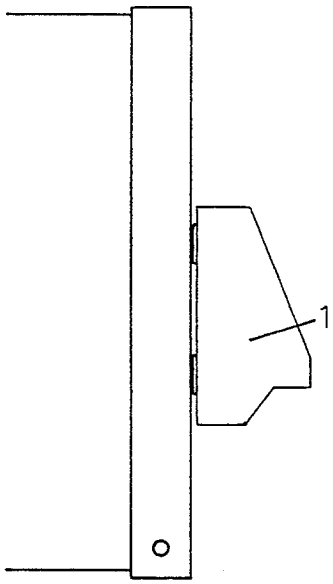
FIG. 2 is the side view of a rural mailbox and how the unit is glued to the box with self adhesive tape.
Figure 3:
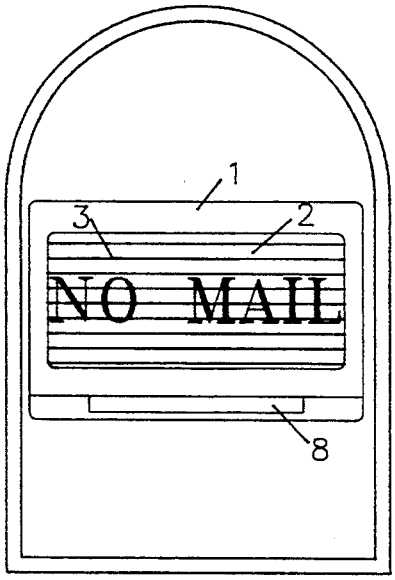
FIG. 3 is the front view of a mailbox before the mail carrier arrives.

As shown in FIG. 1, the unit is attached to the front of what we call a standard rural mailbox model 1-1, PostMaster General approved.

Figure 4:
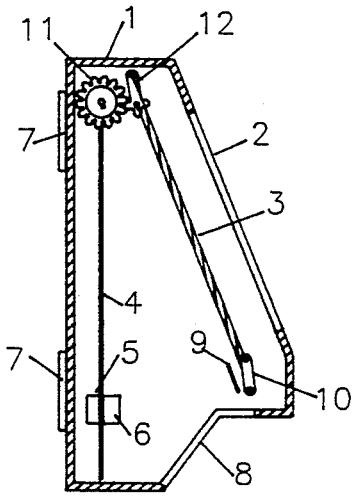
FIG. 4 is the side view of the unit, the working parts before the carrier arrives—the "NO MAIL" position.
Figure 5:
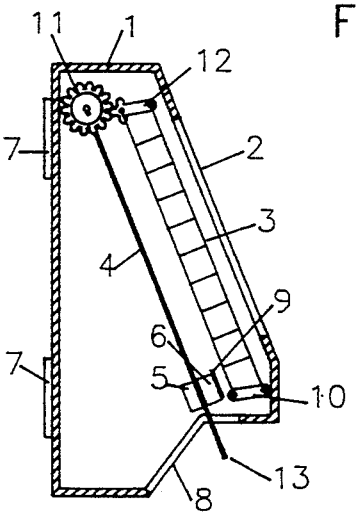
FIG. 5 shows the side view, after the mail carrier has left—the "MAIL" position.

When the mailbox door is opened, the unit tilts 90 degrees foward and therefore causes the backscreen indicator to drop, (refer to FIG. 4). When dropped, the attached magnet 6 swings down and sticks to the metal locking tab 9. This in turn causes the gears 11 & 12 to move. By doing so, the gears open the shutter assembly 3 which will display the mail indicator screen which reads "MAIL".

After picking up your mail and closing the door back, a reset button 13 is pushed to change the indicator 4 back to "NO MAIL". The reset button 13 when pushed, causes the magnet 6 to release from the metal locking tab 9 which in turn causes the gears 11 & 12 to move again. This time the gears 11 & 12 close the shutter assembly 3 and the unit reads "NO MAIL" again.

Note—An open space area 8 is provided to give room for the reset tab to clear the unit housing 1.

What is claimed is:

1. A signal device for use with a rural mailbox comprising a bottom hinged door, the signal device signaling that the door has been opened, the signal device comprising:

a. a unit housing comprising a transparent window;

b. a means of attaching the unit housing to the door, c. a back screen inside the unit housing that pivots forward when the door is opened and comprises a message;

d. a shutter assembly inside the unit housing and in front of the back screen that comprises a message when closed and reveals the back screen when opened;

e. a gearing means that operationally connects the back screen and the shutter assembly so that the shutter assembly opens and closes in response to rotations of the back screen;

f. a means of holding the back screen forward after the door is closed;

g. a reset means to release the back screen to pivot backward after a mail recipient picks up incoming mail.

2. The signal device of claim 1 wherein the means of attachment of the unit housing to the mail box door comprises glue on strips.

3. The signal device of claim 1 wherein the back screen further comprises a weight.

4. The signal device of claim 1 wherein the means of holding the back screen forward comprises a. a metal tab attached to the unit housing and b. a magnet attached to the back screen and aligned with the metal tab.

5. The signal device of claim 1 wherein the reset means comprises a slot in the unit housing through which the bottom edge of the back screen projects.

* * * * *